United States Patent [19]

Hegewaldt et al.

[11] 3,944,715

[45] Mar. 16, 1976

[54] INDUCTION CRUCIBLE FURNACE

[75] Inventors: Fritz Hegewaldt, Herdecke; Horst Gillhaus, Dortmund-Loh; Otto Erdman, Dortmund, all of Germany

[73] Assignee: Brown, Boveri & Cie Aktiengesellschaft, Mannheim, Germany

[22] Filed: Apr. 11, 1974

[21] Appl. No.: 460,184

[30] Foreign Application Priority Data

Apr. 11, 1973 Germany ..... 2318193

[52] U.S. Cl. ..... 13/27

[51] Int. Cl.[2] ..... F27D 11/06

[58] Field of Search ..... 13/26, 27, 35

[56] References Cited

UNITED STATES PATENTS

| | | | |
|---|---|---|---|
| 2,852,587 | 9/1958 | Junker | 13/27 |
| 2,997,512 | 8/1961 | Tama | 13/27 |
| 3,303,259 | 2/1967 | Junker | 13/27 |
| 3,350,494 | 10/1967 | Kunitsky et al. | 13/27 |

*Primary Examiner*—R. N. Envall, Jr.
*Attorney, Agent, or Firm*—Herbert L. Lerner

[57] ABSTRACT

An induction crucible furnace having a crucible surrounded by an induction coil member that is prestressed in axial direction by ring members disposed at opposite ends of the coil member and connected together by a plurality of tie rods extending parallel to the axis of the coil member and distributed uniformly about the periphery of the crucible one of the ring members being fixed to a base frame of the furnace, includes spacer means disposed between the ring members and the coil member and having inner and outer diameters matching those of at least one of the members.

5 Claims, 6 Drawing Figures

INDUCTION CRUCIBLE FURNACE

The invention relates to an induction crucible furnace and more particularly, to such a furnace having a crucible surrounded by an induction coil that is prestressed in axial direction by rings disposed at opposite ends of the coil and connected together by a plurality of tie rods extending parallel to the axis of the coil and distributed uniformly about the periphery of the crucible, the upper or the lower ring, being fixed to a support structure or base frame of the furnace.

In such a furnace, the usually ceramic crucible filled with melt lies close to the coil with an intervening intermediate layer of asbestos serving as thermal insulation, the coil being braced or supported radially outwardly at a base frame of the furnace.

Since the crucible expands with increasing temperature and returns to its original mass when the temperature subsides again, it is necessary, in order to avoid damage to the coil, to fix the latter against axial movement. The rings located at opposite ends of the coil and maintained at a predetermined spacing from one another by tie rods that are adjustable in length and elastic or resilient per se, accordingly serve this purpose.

In heretofore known induction crucible furnaces, the coil has a height which corresponds to that of the furnace. In many cases, therefore, the uppermost and lowermost parts of the coil are deenergized or off-circuit due to the particular arrangement of the current supply leads. The heat losses due to current in the effective middle part of the coil and the heat losses of the crucible in the outer currentless coil sections are absorbed and dissipated by the coolant fluid, such as water, which flows through the entire coil.

A disadvantage of this prior art furnace construction is that, due to the magnetic transverse field extending above and below the middle effective part of the coil, voltages are induced in the outer coil sections through which no current flows and thereby possibly in the metal parts of the furnace base frame, depending upon the remoteness thereof, the thus induced voltages greatly increasing the current consumption of the furnace. In order to reduce these losses, it has been proposed heretofore to provide bundles or packets of a laminated ferromagnetic material between the effective middle part of the coil and the terminal currentless sections thereof. This form of construction is very costly, however, and can be effected only with great difficulty, especially in the case of furnaces having coils that are subjected to stress in axial direction.

It is accordingly an object of the invention to provide an induction crucible furnace which avoids the foregoing disadvantages of the heretofore known furnaces of this general type. More specifically, it is an object of the invention to provide an induction crucible furnace with means for effectively preventing transverse magnetic fields extending in the air above and below the ends of the coil from penetrating into the coil in the direction of the stress applied thereto or from penetrating into the metal parts of the furnace base frame.

With the foregoing and other objects in view, there is provided in an induction crucible furnace having a crucible surrounded by an induction coil member that is prestressed in axial direction by ring members disposed at opposite ends of the coil member and connected together by a plurality of tie rods extending parallel to the axis of the coil member and distributed uniformly about the periphery of the crucible, one of the ring members being fixed to a base frame of the furnace, the improvement therein comprising spacer means disposed between the ring members and the coil member and having inner and outer diameters matching those of at least one of the members.

So that the construction and installation of the spacer means can be effected in an advantageous manner, and in accordance with other features of the invention, the spacer means are either longitudinally slotted cylinders or are in the form of a spiral having a plurality of turns.

In accordance with further alternative features of the invention, the spacer means are formed of a plurality of superimposed rings or ring sections, the latter being uniformly distributed at the periphery of the coil member.

In accordance with additional features of the invention and depending upon the use for the particular embodiment, the spacer means are formed either of insulating material or of nonmagnetic, electrically-conductive material isolated or insulated on all sides thereof, and are fluid-cooled, as by water, to remove heat therefrom.

In order to cut off or neutralize the flow of current in the multipartite spacer means, which can be produced by induced voltages of the transverse magnetic fields originating from the coil and running through the air, there is also provided in accordance with the invention, in order to galvanically separate the individual parts of the spacer means, that the spacer means comprise a plurality of superimposed rings or ring sections respectively formed of insulating material and of nonmagnetic, electrically-conductive material and disposed in layers of predetermined section, the rings or ring sections of nonmagnetic, electrically-conductive material being isolated or insulated on all sides thereof and being either wholly or partly fluid-cooled, as by water.

In order that the spacer means disposed between the ring members and the coil member, which produces strong natural oscillations in the lower frequency range, be securely retained and be protected against eccentricity, the spacer means, in accordance with another feature of the invention, are provided with radially extending projections, such as collars, or other similar means, for guiding the spacer means with respect to either the coil member or the ring members or all thereof.

In accordance with a concomitant feature of the invention, which increases the operational reliability of the furnace, insulating means are located between the ring member and the spacer means as well as between the spacer means and the induction member.

Although the invention is illustrated and described herein as induction crucible furnace, it is nevertheless not intended to be limited to the details shown since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the drawings FIG. 1 of the drawing is a vertical sectional view of an induction crucible furnace constructed in accordance with the invention.

Figures 1, 6:
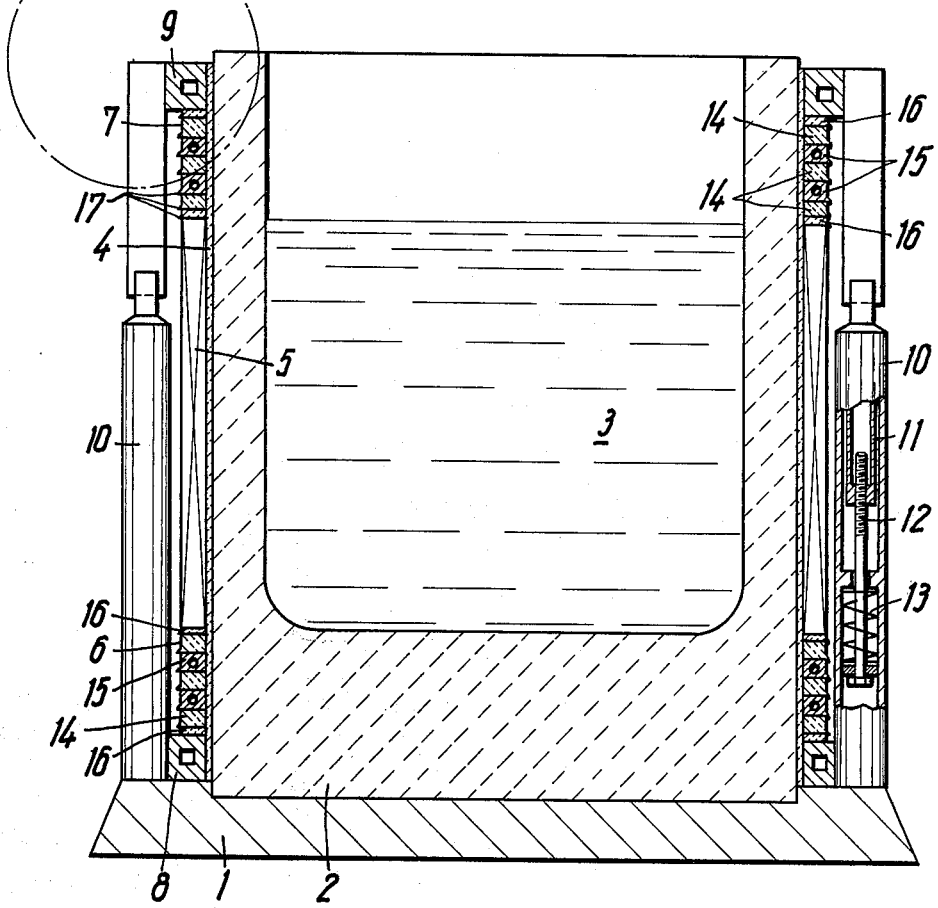
FIGS. 5 and 6 are enlarged fragmentary views of FIGS. 2 and 1, respectively, showing structural details within the suitably identified broken circles.

Referring now to FIG. 1 of the drawing, there is shown therein a support plate 1 carrying a ceramic crucible 2 in which a melt 3 is received. The crucible 2 is radially outwardly braced or supported through an intermediate asbestos layer 4 with a coil 5, that is provided with terminals or junctions for current supply and water cooling, and with spacer members 6 and 7.

The coil 5 and the spacer members 6 and 7 are maintained in pre-stressed condition in axial direction through metallic water-cooled rings 8 and 9 that are connected one to the other by tie rods 10 that are uniformly distributed about the periphery of the crucible 2.

The tie rods 10 are adjustable in length by means of threaded sleeves 11 and screws 12, and per se elastic or resilient due to the set of springs 13 with which they are respectively provided.

In the illustrated embodiment of FIG. 1, the spacer members 6 and 7 are formed of superimposed rings 14 and 15 that are alternatingly disposed. The rings 14 are solid, as shown in the cross-sectional view thereof in the figure, and are formed of insulating material. The other rings 15 are provided with bores, as shown in the figure, for conducting coolant water therethrough. Moreover the other rings 15 are formed of nonmagnetic, electrically-conductive material which is isolated or insulated on all sides thereof.

Layers of insulation are also provided between the rings 8 and 9 and the spacer members 6 and 7, respectively, as well as between the latter and the coil 5.

The rings 14 and 15 and the insulating layers 16 are provided at the outer surfaces thereof with peripheral collars 17 received in corresponding recesses 18 (note FIG. 6) for guiding and centering the rings 14 and 15 and the insulating layers 16 with respect to one another and with respect to the coil 5 and the rings 8 and 9.

Figure 2:
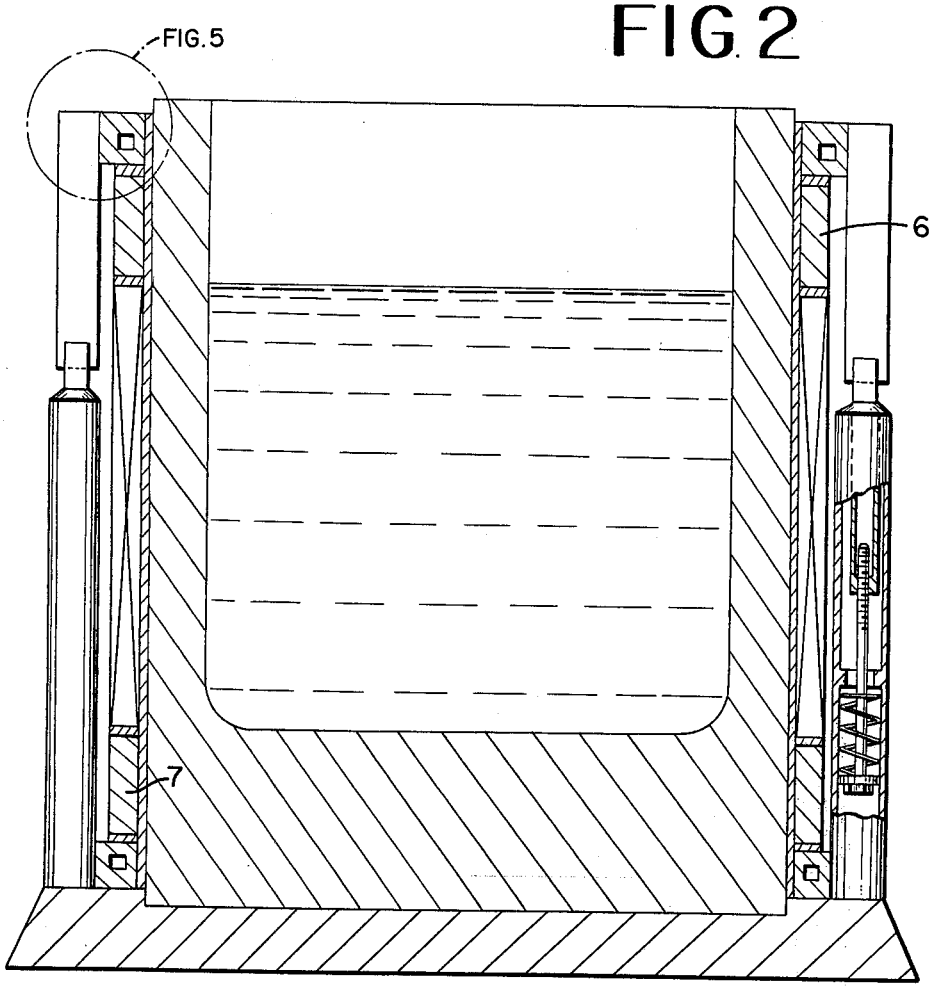
FIG. 2 is a view similar to that of FIG. 1 of another embodiment of the induction crucible furnace of the invention, employing a plurality of superimposed ring sections at the periphery of the coil member.
Figure 3:
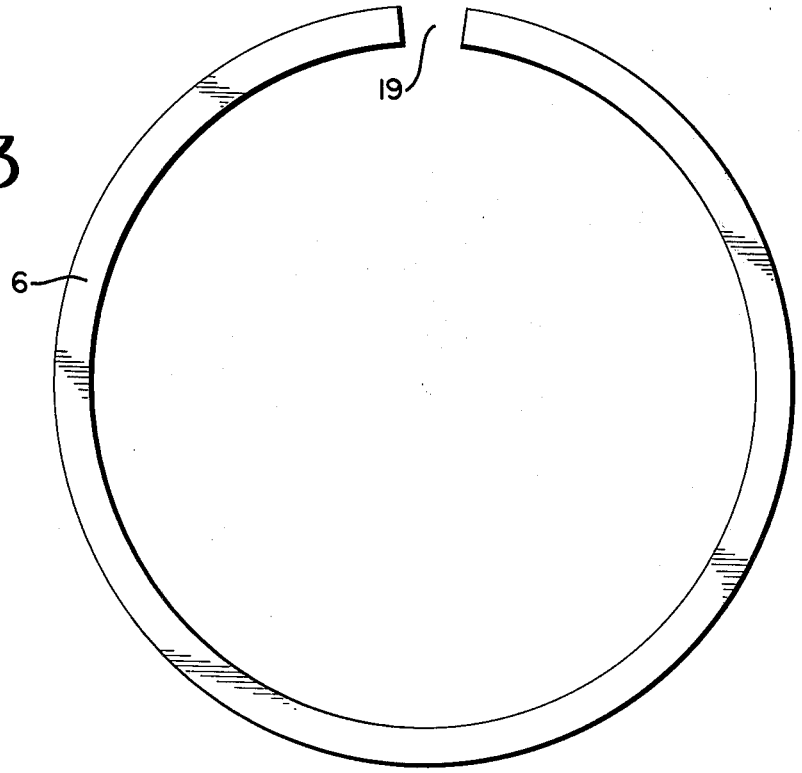
FIG. 3 is a top plan view of the cylindrical spacer member 6 of FIG. 1.
Figure 4:
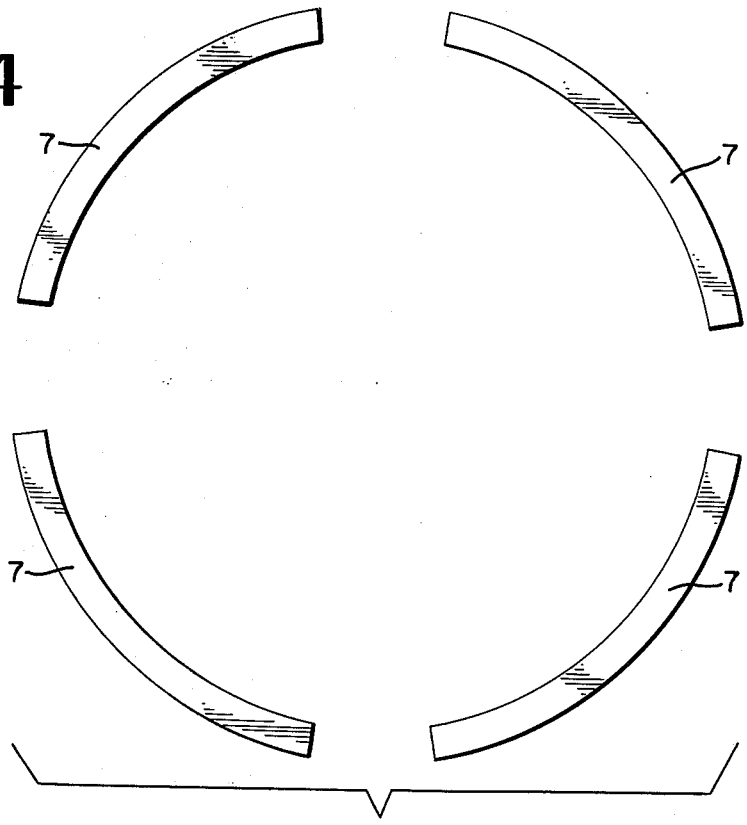
FIG. 4 is a top plan view of one layer of the ring sections of the spacer member of FIG. 2.
Figure 5:
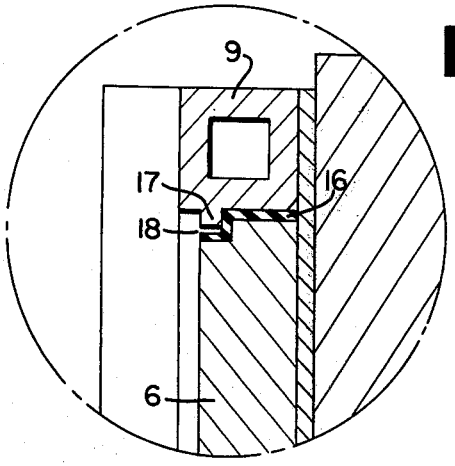
Figure 6:
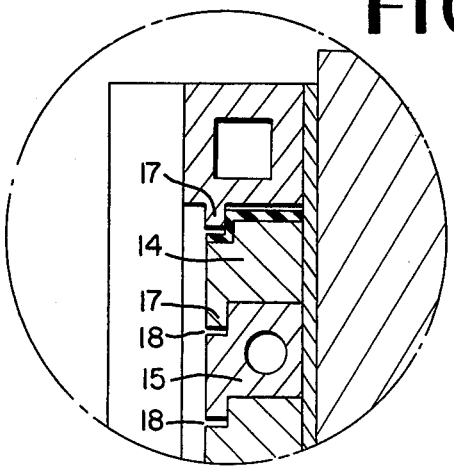

In addition to being formed of rings, as in the aforedescribed embodiment, the spacer members 6 and 7 may also be formed of longitudinally slotted cylinders, as shown in FIGS. 2, 3 and 5, the slot 19 being clearly shown in FIG. 5, a spiral member having a plurality of turns or superimposed ring sections uniformly distributed at the periphery of the coil 5, as shown in FIG. 4.

Thus, the advantages derived from the invention of the instant application are especially that the power losses are diminished and, due to the lower consumption of electrical energy resulting therefrom, the operation of the furnace becomes more efficient than heretofore possible.

We claim:

1. In an induction crucible furnace having a crucible surrounded by an induction coil member that is prestressed in axial direction by ring members disposed at opposite ends of the coil member and connected together by a plurality of tie rods extending parallel to the axis of the coil member and distributed uniformly about the periphery of the crucible, one of the ring members being fixed to a base frame of the furnace, the improvement therein comprising spacer means disposed between and separating the ring members and the coil member and having inner diameters matching at least one of the ring members, said spacer means comprising longitudinally slotted cylinders.

2. In an induction crucible furnace having a crucible surrounded by an induction coil member that is prestressed in axial direction by ring members disposed at opposite ends of the coil member and connected together by a plurality of tie rods extending parallel to the axis of the coil member and distributed uniformly about the periphery of the crucible, one of the ring members being fixed to a base frame of the furnace, the improvement therein comprising spacer means disposed between and separating the ring members and the coil member and having inner diameters matching at least one of the ring members, said spacer means comprising a plurality of superimposed ring sections uniformly distributed at the periphery of the coil member.

3. In an induction crucible furnace having a crucible surrounded by an induction coil member that is prestressed in axial direction by ring members disposed at opposite ends of the coil member and connected together by a plurality of tie rods extending parallel to the axis of the coil member and distributed uniformly about the periphery of the crucible, one of the ring members being fixed to a base frame of the furnace, the improvement therein comprising spacer means disposed between and separating the ring members and the coil member and having inner diameters matching at least one of the ring members, said spacer means comprising a plurality of superimposed sections of rings respectively formed of insulating material and of nonmagnetic, electrically-conductive material and disposed in layers of predetermined selection, the ring sections of nonmagnetic electrically-conductive material being electrically insulated on all sides thereof and being at least partly fluid-cooled.

4. In an induction crucible furnace having a crucible surrounded by an induction coil member that is prestressed in axial direction by ring members disposed at opposite ends of the coil member and connected together by a plurality of tie rods extending parallel to the axis of the coil member and distributed uniformly about the periphery of the crucible, one of the ring members being fixed to a base frame of the furnace, the improvement therein comprising spacer means disposed between and separating the ring members and the coil member and having inner diameters matching at least one of the ring members, said spacer means being formed with radially extending projections for guiding and centering said spacer means with respect to at least one of said members.

5. Induction crucible furnace according to claim 4 wherein said radially extending projections are collars formed on said spacer means.

* * * * *